US006743117B2

(12) United States Patent
Gilbert

(10) Patent No.: US 6,743,117 B2
(45) Date of Patent: Jun. 1, 2004

(54) GOLF CLUB HEAD WITH FACE INSERTS

(75) Inventor: Peter J. Gilbert, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/242,913

(22) Filed: Sep. 13, 2002

(65) Prior Publication Data

US 2004/0053704 A1 Mar. 18, 2004

(51) Int. Cl.[7] ..... A63B 53/04
(52) U.S. Cl. ..... 473/332; 473/342; 473/350
(58) Field of Search ..... 473/324, 342, 473/350, 332

(56) References Cited

U.S. PATENT DOCUMENTS

| | | | | | |
|---|---|---|---|---|---|
| 819,900 | A | | 5/1906 | Martin | |
| 1,359,220 | A | | 11/1920 | Beamer | |
| 4,884,812 | A | | 12/1989 | Nagasaki | 273/167 H |
| 5,198,062 | A | | 3/1993 | Chen | 156/245 |
| 5,299,807 | A | | 4/1994 | Hutin | 273/173 |
| 5,398,929 | A | | 3/1995 | Kitaichi | 273/78 |
| 5,403,007 | A | | 4/1995 | Chen | 273/173 |
| 5,423,535 | A | * | 6/1995 | Shaw et al. | 473/291 |
| 5,431,396 | A | | 7/1995 | Shieh | 273/78 |
| 5,467,983 | A | * | 11/1995 | Chen | 473/342 |
| 5,524,331 | A | * | 6/1996 | Pond | 29/527.4 |
| 5,749,794 | A | * | 5/1998 | Kobayashi et al. | 473/342 |
| 5,924,261 | A | | 7/1999 | Fricke | 52/720.1 |
| 5,967,903 | A | | 10/1999 | Cheng | 473/342 |
| 6,042,486 | A | | 3/2000 | Gallagher | 473/329 |
| 6,183,381 | B1 | * | 2/2001 | Grant et al. | 473/342 |
| 6,224,341 | B1 | | 5/2001 | Fricke | 416/248 |
| 6,237,302 | B1 | | 5/2001 | Fricke | 52/729.1 |
| 6,290,607 | B1 | | 9/2001 | Gilbert et al. | 473/291 |

* cited by examiner

*Primary Examiner*—Stephen Blau
(74) *Attorney, Agent, or Firm*—D. Michael Burns

(57) ABSTRACT

An iron style golf club head comprising a substantially perimeter weighted club head, including the interposing of three inserts, a striking face insert, a dampening insert and a back insert. The dampening insert, preferably made of a lead alloy, is interposed between the other inserts, and provides for changes in club swing weight while also providing relief for vibration and acoustical variations. The striking face insert is preferably made from a stainless steel alloy and the back inset is preferably made from a carbon graphite.

The dampening insert is maneuvered into varied positions to effect a change in the specific gravity of each club head of a golf club set.

12 Claims, 5 Drawing Sheets

GOLF CLUB HEAD WITH FACE INSERTS

FIELD OF THE INVENTION

The present invention relates to the field of golf club design. Specifically, the invention us directed to an improved "iron-style" golf club head having multiple face inserts pressed into an open face pocket.

BACKGROUND OF THE INVENTION

Over the recent years, golf clubs have undergone significant design improvements. Perhaps the most significant improvement in golf club design has been the introduction of perimeter weighting to both iron-style and wood-style club heads. Perimeter weighting encompasses the removal of metal from central portions of a clubhead and the redistribution thereof to the perimeter of the head. This results in an expansion of the "sweet spot" of the clubface. When a golf ball is struck by a club substantially at its sweet spot, the golf ball will experience its optimal trajectory and distance. While great advances have been made in weighting technology of club heads themselves, the removal and redistribution of mass in club heads has affected the swing weight of many perimeter weighted clubs.

The typical teachings in the art today prefer softer alloy iron-style clubs, where club "feel" is considered of paramount importance. In fact most touring professional golfers still use forged, blade-style irons, which are made of steel alloys that provide optimum club feel. Unfortunately, the average golfer does not possess the skill to truly "feel" the difference when his or her club strikes a golf ball at different positions on the club face, let alone control the same.

The individual golf clubheads in a set typically increase progressively in strike face surface area and weight as the clubs progress from the long irons to the short irons. Therefore, the clubheads of the long irons have a smaller strike face surface area than the short irons and are typically more difficult for the average golfer to hit consistently well. For conventional clubheads, this arises at least in part due to the smaller sweet spot of the corresponding smaller strike face.

To help the average golfer consistently hit the sweet spot of a club head, many golf clubs are available having heads with so-called cavity back designs with increased perimeter weighting. Another more recent trend has been to simply increase the overall size of the clubheads, especially in the long irons. Each of these features will increase the size of the sweet spot and therefore make it more likely that a shot hit slightly off the center of gravity of the club head still makes contact with the sweet spot and flies farther and straighter as a result. One challenge for the golf club designer when maximizing the size of the clubhead concerns maintaining a desirable and effective overall weight of the golf club. For example, if the clubhead of a three iron is increased in size and weight, the club may become difficult for the average golfer to properly swing.

Another problem area for the average golfer is that of excess vibration resulting from an off center impact with the golf ball. Various types of vibration dampeners have been incorporated into clubheads to absorb these impact vibrations. However, there is still need for improvement in both the area of weight redistribution and vibration dampening in golf club heads, especially oversize iron type club heads.

SUMMARY OF THE INVENTION

The disclosed invention is an improved, iron-style golf club, which comprises a clubhead having a front portion in which a cavity is defined therein. Interposed within the cavity are a plurality of inserts. A strike face insert which is preferably made of stainless steel is backed by a dampening insert that is preferably backed by a light weight back insert. Preferably, the dampening insert has a specific gravity greater than the face insert and the light weight insert has a specific gravity less than the face insert. Preferably the dampening material has a tensile modulus that is less than the face insert and the light weight material has a tensile modulus that is greater than the face insert.

The dampening insert is preferably formed of soft lead to significantly soften the "feel" of the iron. The high density of lead alloy also brings the head back up to the required head weight. Other suitable dampening materials include tungsten filled polymers.

The thickness of the heavy dampening material can be varied in combination with the insert to achieve various head weight requirements. By increasing the thickness of the dampening insert and decreasing the thickness of the light weight insert, it is possible to increase the head weight without any change in the cavity volume.

Preferably, the dampening material is very moldable under pressure, so that it fills all the void regions behind the face and between the body. The light weight insert on the back supports the dampening material and prevents it from squeezing out.

The position and amount of the heavier weighted material can be altered in relation to the club face. Therein, the specific gravity of the iron head will be, at the lowest point for long irons (such as a two iron), and will rise incrementally as the irons get shorter.

These and still other objects of the disclosed invention will become apparent from the following description.

DETAILED DESCRIPTION OF THE PREFERRED EMBODIMENTS

Figure 1:
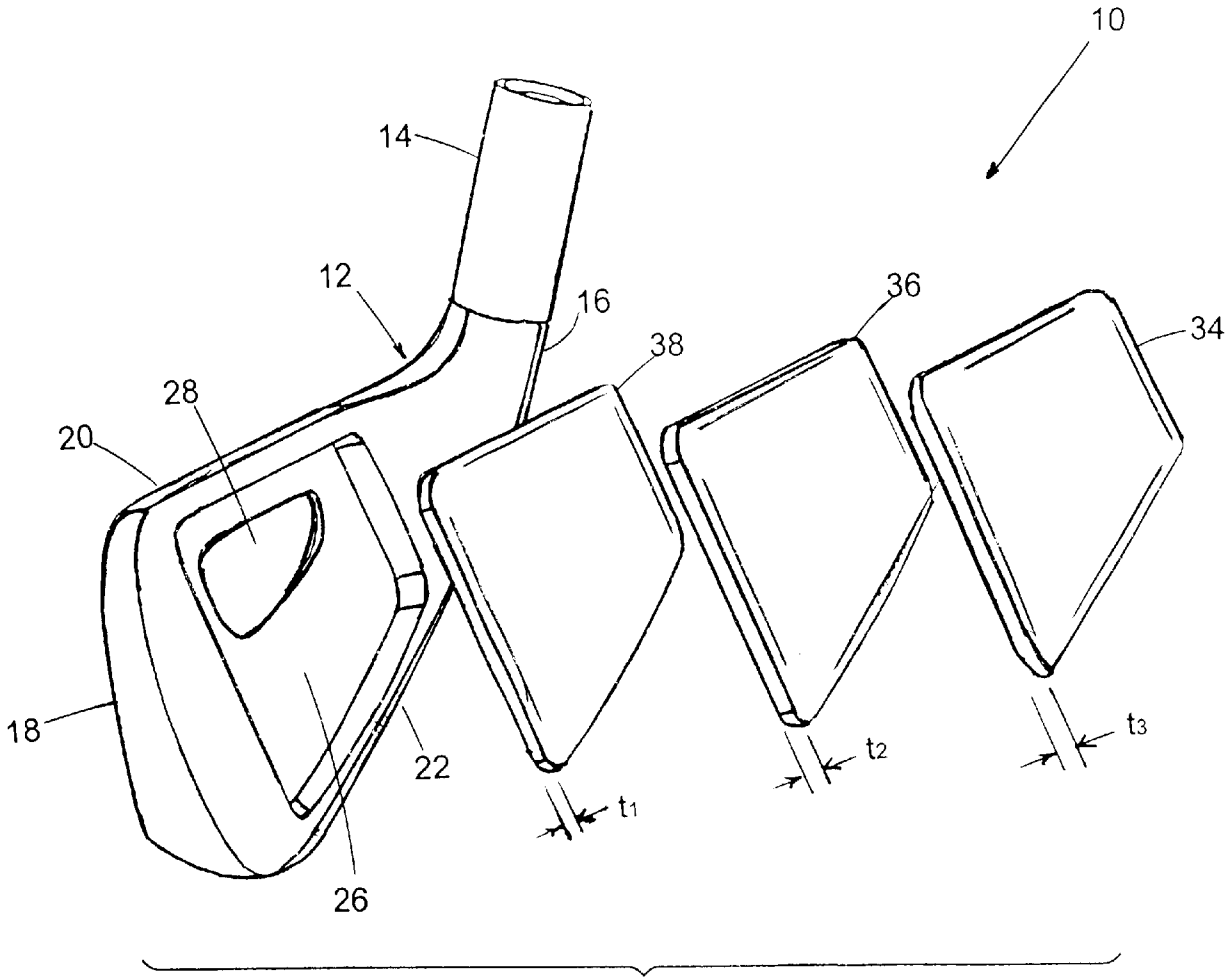
FIG. 1 is an exploded perspective view of one embodiment of the present invention.

Referring first to FIG. 1, an iron clubhead 10 constructed in accordance with a preferred embodiment of this invention is shown and includes a body 12 having hosel portion 14, heel portion 16, toe portion 18, upper edge 20 and lower edge 22. As shown best in FIGS. 1, 2 and 3, clubhead body 12 includes front portion 24 with cavity 26, and a back portion 25 having an aperture 28 therein. In FIG. 1, the cavity 26 receives a strike face insert 34, dampening insert 36 in back of the strike face insert 34 and a composite back insert 38 supporting the dampening insert 36. The aperture 28 allows for the viewing of the composite back insert 38.

Figure 3:
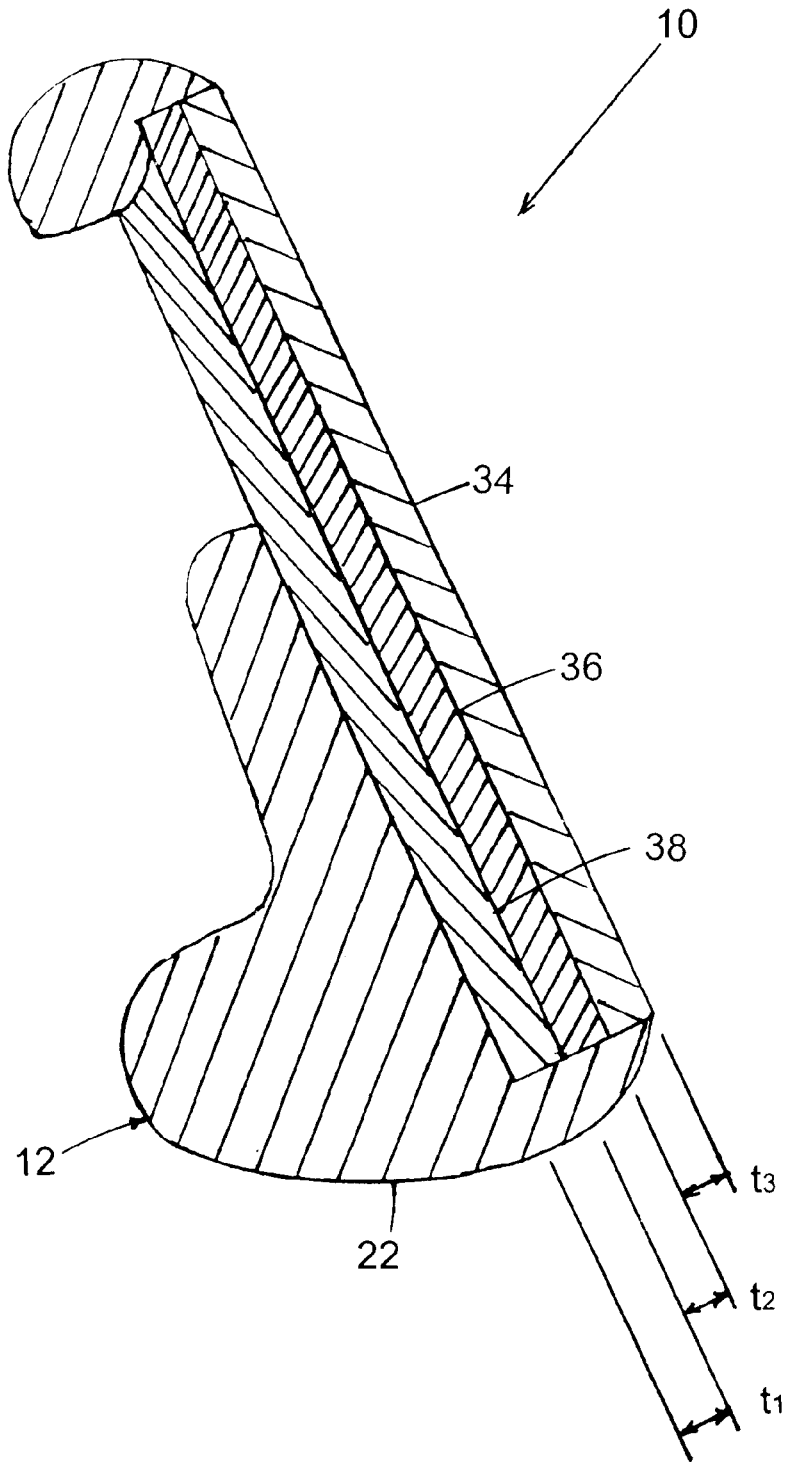
FIG. 3 is a cross-sectional view taken along line A—A of FIG. 2.

Strike face insert 34 is preferably made from stainless steel, although the skilled artisan will recognize that other suitable materials, such as titanium, brass and carbon steel (having sufficient strength characteristics and a strength to weight ratio), may be substituted without deviating from the scope of the invention. Strike face insert 34 is preferably coldworked into cavity 26 and includes conventional grooves 38 on a front surface thereof. Undercuts (not detailed herein) may be provided along the peripheral edge of cavity 26 for holding the inserts 34, 36 and 38 in place as shown in FIG. 3. The strike face insert 34 has a thickness ($t_1$) that is preferably in the range between about 0.07 inches to about 0.11 inches, and more preferably about 0.09 inches.

Placed into the cavity 26, in back of the strike face insert 34 is the vibration dampening insert 36, formed preferably of lead which dissipates the vibration energy effectively enough to minimize resonance and propagation of vibrations, as well as to reduce acoustic noises. Dampening insert 36 preferably has a thickness ($t_2$) that is in the range between about 0.005 inches to about 0.025 inches, and more preferably is about 0.01 inches. Lead, being very moldable under pressure, fills all voids behind the strike face insert 34 and between the body 12. The dampening insert 36, being made of lead, provides for a measure of "feel" which is so highly desired by golfers of all skill levels. The skilled artisan will readily recognize that many different shock absorbing materials may be substituted without deviating from the scope of the invention. Other suitable materials for dampening insert 36 in accordance with the present invention includes without limitation viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; air bladders; liquid bladders; and mixtures thereof. The metallized polyesters and acrylics preferably comprise aluminum as the metal. Piezoelectric ceramics particularly allow for specific vibration frequencies to be targeted and selectively damped electronically. Commercially available dampening and acoustical materials applicable for the present invention include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFleX™ Sylomer® from Pole Star Maritime Group, LLC, and Legetolex™ from Piqua Technologies, Inc.

Another group of suitable dampening and acoustical materials are low-density granular materials that when coupled to structures for the purpose of reducing structural vibrations, provide a concomitant attenuation in airborne acoustic noises radiated from the structure. Such low-density granular materials including without limitation perlite; vermiculite; polyethylene beads; glass microspheres; expanded polystyrene; nylon flock; ceramics; polymeric elastomers; rubbers; dendritic particles; and mixtures thereof. Low-density granular materials with dendritic structures and low bulk sound speeds are used to maximize damping of low-frequency vibrations and attenuating acoustic noises in club heads. Technology associated with the use of these low-density granular materials for damping structural vibrations is described by the trademark name Lodengraf™. Other low-density granular materials and their applications in various dampening acoustical systems are described in U.S. Pat. Nos. 5,924,261, 6,224,341, and 6,237,302, the disclosures of which are incorporated herein by reference in their entirety.

As previously stated, a back insert 38, preferably made of carbon graphite material, is pressed into the cavity 26, just in back of the dampening insert 36. This back insert 38 will prevent the dampening material from "squeezing" out, and will provide a support for the malleable material. The thickness ($t_3$) of the back sheet 38 is preferably in the range between about 0.02 inches to about 0.04 inches and more preferably about 0.03 inches. The aperture 28, in the back of the body 12, allows for the back insert 38 to be viewable as well as having material removed thereby increasing the perimeter weighing of the club head.

The cavity 26 is limited in depth and the three inserts 34, 36 and 38, may vary in thickness to achieve predetermined club characteristics. As an example, if the depth of the cavity 26 were approximately 0.14 inches and an embodiment had a thickness of 0.095 inches for the face insert 34, 0.005 inches for the dampening insert 36 and 0.04 inches for the back insert 38, then an increase in the thickness of one insert would mean a decrease in thickness for at least one other. An increase in the thickness of the heavy weighted lead dampening insert 36 would make for a heavier club head and vice versa for a reduction in the thickness of the dampening insert 36.

The reduction of vibration and refinement of acoustics provides the club 10 of the present invention, with playing qualities that approach those achieved with forged clubs, but with a much larger "sweet spot" than is available with forged clubs.

Figure 4C:
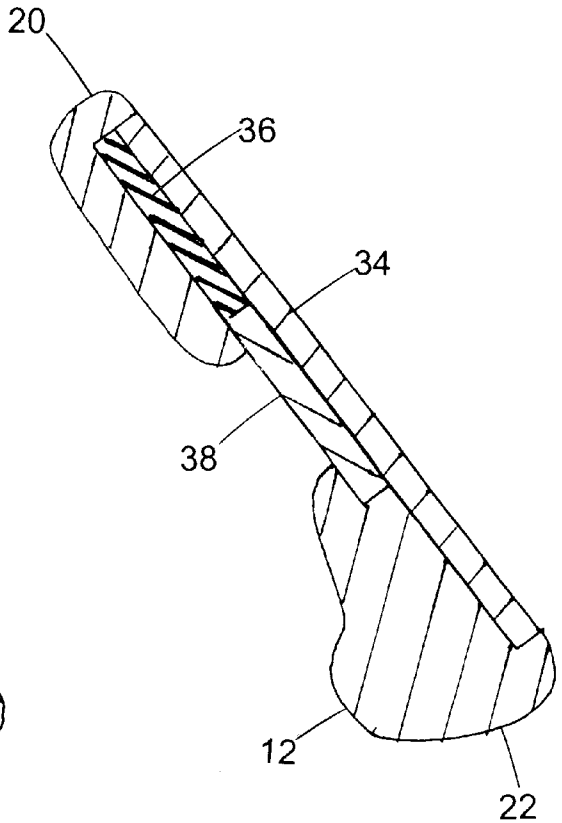
FIG. 4*c* is a cross-sectional view of a wedge of the embodiment of FIG. 4*a*.
Figure 4B:
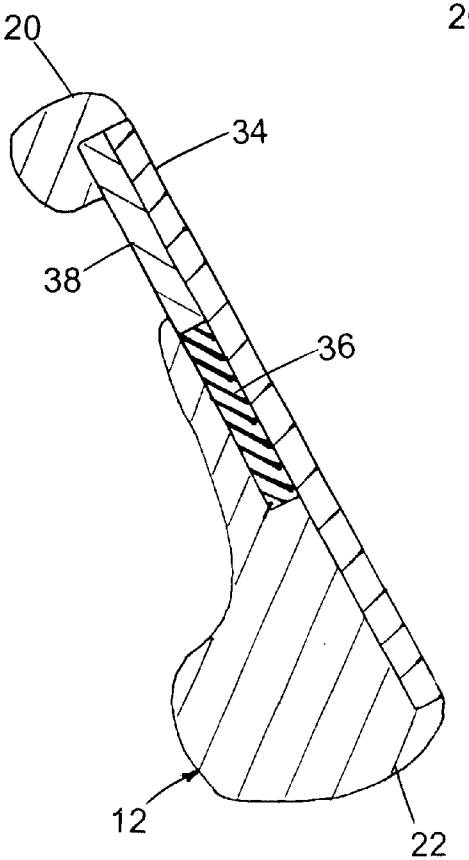
FIG. 4*b* is a cross-sectional view of a mid-iron of the embodiment of FIG. 4*a*.
Figure 4A:
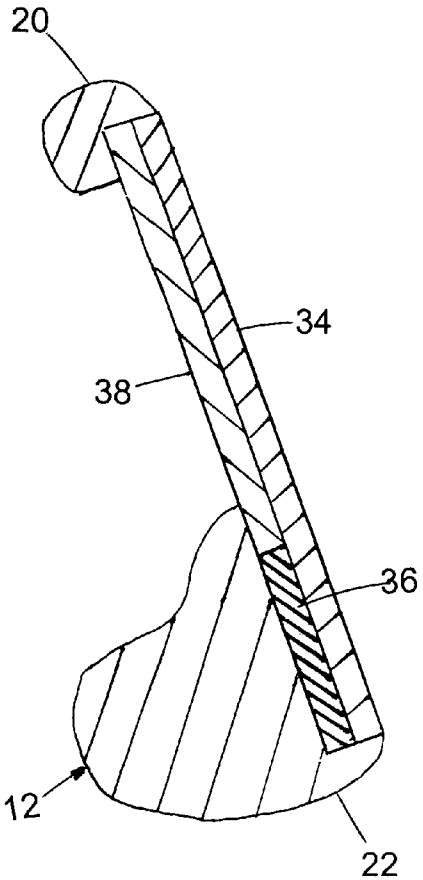
FIG. 4*a* is a cross-sectional view of a long iron of an alternate embodiment of the invention.

In an embodiment of the invention, a set of iron golf club heads of the invention is either a set of eleven iron club heads including the 1st to 9th irons, a pitching wedge and a sand wedge, or a set of plural iron club heads excluding some therefrom. All of these golf club heads are not shown in the drawings. A 2 iron, 6 iron and pitching wedge are selected to show the inventive concept, which is best illustrated in FIGS. 4*a* to 4*b* and 5*a* to 5*b*. Typically, in a set of iron golf clubs, the 1, 2, 3 and 4 irons are considered "long" irons, the 5, 6 and 7 are considered intermediate irons and the 8, 9 and wedges are referred to as "short" irons. As the numerical sequence of the irons goes up, the length of their shafts get progressively shorter. Drawings 4*a*–4*c* depict the dimensional concept wherein the location of the heavier weighted dampening insert 36 is positioned higher to achieve a higher center of gravity in the higher numerically sequenced irons. In FIG. 4*a*, the dampening insert 36 is at a relatively low position for the 2 iron head, thereby giving it a higher launch projectory. In FIG. 4*b*, in the iron head depicting a 6 iron, the dampening insert 36 is about at the midpoint between the lower edge 22 and the upper edge 20 thereby raising the specific gravity for a lower projectory and therein giving the golfer an added measure of control over the shot. In FIG. 4*c*, the dampening insert 36 is yet still at a point further away from the lower edge 22 thereby providing the short wedge iron with a high center of gravity for better shot control. As previously stated, as a club sequence number gets progressively higher, the shaft becomes shorter and is accompanied by an increasing weight of the head. Further, the larger a club number becomes, the larger a loft angle or an angle of the front portion 24 to a vertical plane becomes. Furthermore, the larger a club number becomes, the larger a lie angle or an angle of the shaft to a horizontal plane becomes as well.

In general, longer irons require longer travelling distances of balls than shorter irons. In other words, the smaller the number of an iron club, the longer travelling distance it requires. Manipulating the club head center of gravity locations creates an impulse vector that has an upward directed vertical component in the long irons therein increasing the club's ability for getting the ball airborne. The high numbered club irons, having large lofts, provide no problem in getting the ball airborne and, in fact, extremely high ball trajectories can adversely affect hitting accuracy for these irons. This tendency for high ball trajectories is reduced with higher centers of gravity for the club head.

Figure 2:
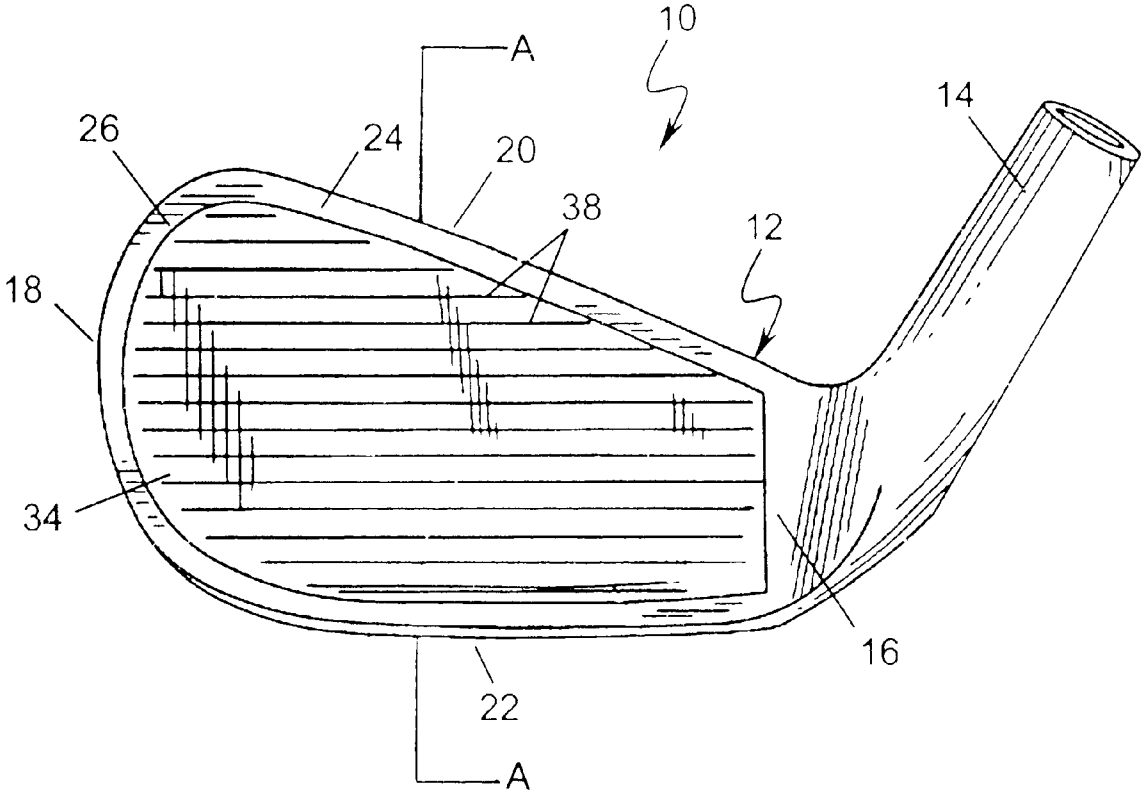
FIG. 2 is a front elevational view of the embodiment described in FIG. 1.
Figure 5C:
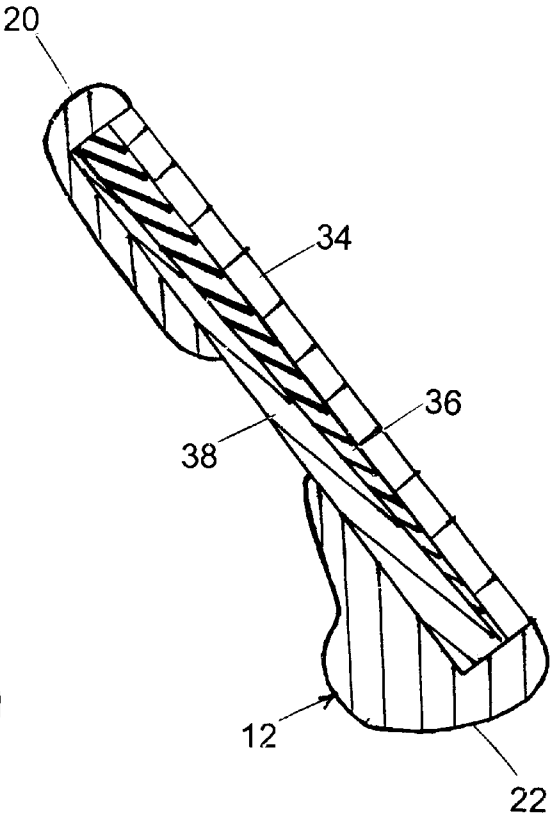
FIG. 5*c* is a cross-sectional view of a wedge of the embodiment of FIG. 5*a*.
Figure 5B:
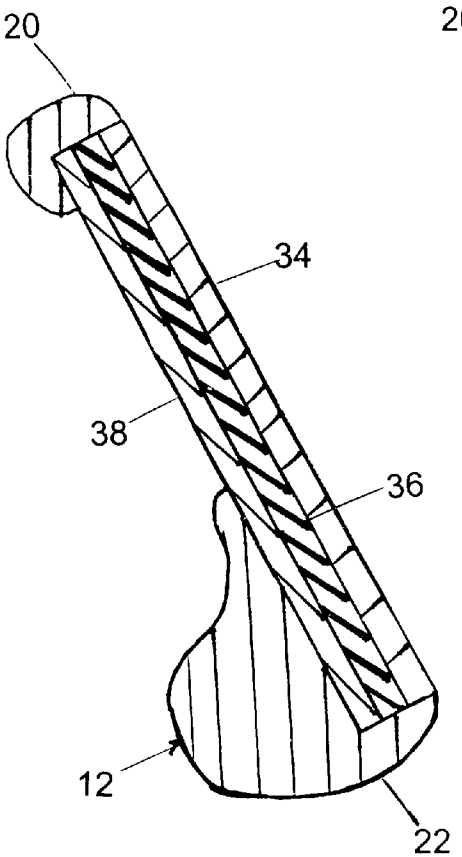
FIG. 5*b* is a cross-sectional view of a mid-iron of the embodiment of FIG. 5*a*.
Figure 5A:
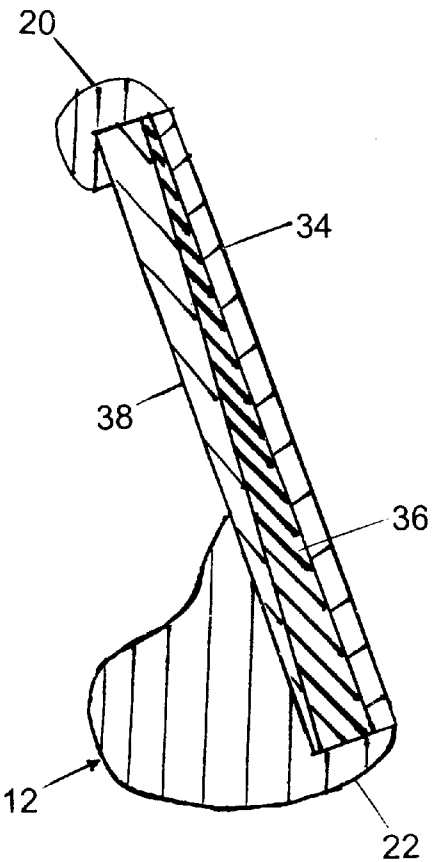
FIG. 5*a* is a cross-sectional view of a long iron of another alternate embodiment of the invention.

In the embodiment depicted in FIGS. 5*a*, 5*b* and 5*c*, the same principle of weight distribution and gradual elevation of the center of gravity as previously illustrated in FIGS. 4*a*–4*b* is utilized, but with a geometric scheme more like the preferred embodiment shown in FIGS. 1 to 3. This embodiment shifts the specific gravity of the iron head by coordinating the weight ratio between the dampening insert 36 and the back insert 38.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A golf club head with improved weight distribution and vibration dampening, the golf club head comprising:

a body having a front portion defining a cavity therein;

a strike face insert, a dampening insert and a back insert disposed within the cavity, the dampening insert being located between the strike face insert and the back insert; and, wherein the dampening insert is made from a lead alloy.

2. The golf club head according to claim 1, wherein the strike face insert has a thickness in the range between about 0.07 to 0.11 inches.

3. The golf club head according to claim 1, wherein the strike face insert has a thickness of about 0.09 inches.

4. The golf club head according to claim 1, wherein the dampening insert has a thickness in the range between about 0.005 to about 0.025 inches.

5. The golf club head according to claim 1, wherein the dampening insert has a thickness of about 0.010 inches.

6. The golf club head according to claim 1, wherein the back insert is made from carbon graphite material.

7. The golf club head according to claim 1, wherein the back insert has a thickness between about 0.02 to about 0.04 inches.

8. The golf club head according to claim 1, wherein the back insert has a thickness of about 0.03 inches.

9. The golf club head according to claim 1, wherein the total thickness of the strike face insert, dampening insert and back insert is between about 0.12 inches and 0.15 inches.

10. The golf club head according to claim 1, wherein the total thickness of the strike face insert, dampening insert and back insert is about 0.14 inches.

11. The golf club head according to claim 1, wherein the body includes a back portion having an aperture defined therein, the back insert viewable through the aperture.

12. A golf club head with improved weight distribution and vibration dampening, the golf club head comprising:

a body having a front portion defining a cavity therein;

a strike face insert, a dampening insert and a back insert disposed within the cavity, the dampening insert being located between the strike face insert and the back insert; and wherein the dampening insert is made from a lead alloy and the strike face insert is made form a titanium alloy.

* * * * *